US008375849B2

(12) United States Patent
Sajjad et al.

(10) Patent No.: US 8,375,849 B2
(45) Date of Patent: Feb. 19, 2013

(54) METHOD AND APPARATUS FOR AN AIR INLET IN A COOKING DEVICE

(75) Inventors: Adam Sajjad, Burnham (GB); Matthew Underwood, Dorking (GB); Chris Anthony, Reading (GB)

(73) Assignee: Manitowoc Foodservice Companies, LLC, Manitowoc, WI (US)

( * ) Notice: Subject to any disclaimer, the term of this patent is extended or adjusted under 35 U.S.C. 154(b) by 0 days.

(21) Appl. No.: 12/872,862

(22) Filed: Aug. 31, 2010

(65) Prior Publication Data

US 2011/0052774 A1 Mar. 3, 2011

Related U.S. Application Data

(60) Provisional application No. 61/275,609, filed on Sep. 1, 2009.

(51) Int. Cl.
*F24C 15/20* (2006.01)
*H05B 6/64* (2006.01)

(52) U.S. Cl. ..... 99/468; 99/467; 219/757; 219/391; 219/400; 126/299 D; 126/193; 126/198

(58) Field of Classification Search ..... 99/467, 99/468, 470, 473, 474; 219/623, 391, 400, 219/757; 126/299 D, 193, 198, 77, 80, 21 A
See application file for complete search history.

(56) References Cited

U.S. PATENT DOCUMENTS 3,654,417 A 4/1972 Javes et al.
4,097,709 A 6/1978 Bächtold et al.
4,123,643 A 10/1978 Burke
4,133,995 A 1/1979 Buck
4,162,381 A 7/1979 Buck
4,180,049 A 12/1979 Carr et al.
4,181,744 A 1/1980 Buck
4,221,949 A 9/1980 Minakawa
4,289,945 A 9/1981 Kristof
4,308,444 A 12/1981 Takagi et al.
4,332,993 A 6/1982 Shibahara et al.
4,369,347 A 1/1983 Shin
4,403,128 A 9/1983 Takagi et al.
4,463,238 A 7/1984 Tanabe
4,480,164 A 10/1984 Dills
4,618,756 A 10/1986 Schwaderer et al.
4,857,685 A 8/1989 Vigano et al.
4,956,531 A 9/1990 Braunisch et al.
4,962,592 A 10/1990 Orizand
5,211,159 A 5/1993 Lieblein et al. ..... 126/299
5,279,788 A 1/1994 Kudo et al.
5,302,793 A 4/1994 Eke
5,393,961 A 2/1995 Umekage et al. ..... 219/757
5,693,248 A 12/1997 Kim
5,756,974 A 5/1998 Hong
(Continued)

OTHER PUBLICATIONS

International Search Report and Written Opinion dated Oct. 15, 2010 for corresponding International Patent Application No. PCT/US2010/047375.

(Continued)

*Primary Examiner* — Reginald L Alexander
(74) *Attorney, Agent, or Firm* — Ohlandt, Greeley, Ruggiero & Perle, LLP

(57) ABSTRACT

A cooking device includes a housing having an opening, an airflow device that draws air into the housing through the opening, a filter that is removably connected to the housing to cover the opening, and a controller that controls an amount of the air drawn into the housing based upon a presence of the filter covering the opening or an absence of the filter covering the opening.

19 Claims, 4 Drawing Sheets

U.S. PATENT DOCUMENTS

| | | | | |
|---|---|---|---|---|
| 5,886,330 | A | 3/1999 | Kang et al. | |
| 5,918,589 | A | 7/1999 | Valle et al. | |
| 6,051,824 | A | 4/2000 | Choi et al. | |
| 6,116,364 | A | 9/2000 | Taguchi et al. | |
| 6,150,648 | A | 11/2000 | Kang et al. | |
| 6,278,098 | B1 | 8/2001 | Han et al. | |
| 6,316,758 | B1 | 11/2001 | Ubowski et al. | |
| 6,346,692 | B1 | 2/2002 | Ubowski et al. | |
| 6,621,057 | B2 | 9/2003 | Kim | |
| 6,707,019 | B2 | 3/2004 | Kim | |
| 6,768,090 | B2 | 7/2004 | Kang | |
| 6,774,347 | B2 | 8/2004 | Shon et al. | |
| 6,849,840 | B2 | 2/2005 | Sung | |
| 6,852,963 | B2 | 2/2005 | Jeong | |
| 6,861,631 | B2 | 3/2005 | Hahm et al. | |
| 6,878,195 | B2 | 4/2005 | Gibson | 96/224 |
| 6,965,101 | B2 | 11/2005 | Kim et al. | |
| 6,974,937 | B2 | 12/2005 | Kim | |
| 6,992,273 | B2 | 1/2006 | Yim et al. | |
| 7,019,272 | B2 | 3/2006 | Braunisch et al. | |
| 7,041,949 | B2 | 5/2006 | Kim | |
| 7,049,569 | B2 | 5/2006 | Kim | |
| 7,098,432 | B2 | 8/2006 | Rew et al. | |
| 7,122,771 | B2 | 10/2006 | Kang | |
| 7,145,118 | B1 | 12/2006 | Wu | |
| 7,193,195 | B2 | 3/2007 | Lundstrom et al. | |
| 7,348,527 | B2 | 3/2008 | Braunisch et al. | |
| 7,375,310 | B2 | 5/2008 | Oh et al. | |
| 2007/0102418 | A1 | 5/2007 | Swank et al. | 219/400 |
| 2007/0102426 | A1* | 5/2007 | Braunisch et al. | 219/757 |

OTHER PUBLICATIONS

International Preliminary Report on Patentability Issued Dec. 15, 2011 in the corresponding PCT/US2010/047375.

* cited by examiner

METHOD AND APPARATUS FOR AN AIR INLET IN A COOKING DEVICE

CROSS-REFERENCE TO RELATED APPLICATIONS

This application claims the benefit of U.S. Provisional Application No. 61/275,609, filed Sep. 1, 2009. U.S. Provisional Application No. 61/275,609, filed Sep. 1, 2009 is hereby incorporated by reference in its entirety.

BACKGROUND OF THE INVENTION

1. Field of the Invention

The present disclosure relates generally to drawing air into a cooking device. More particularly, the present disclosure relates to a filter removably connected to an opening through a housing of a cooking device.

2. Description of Related Art

Microwave and combination microwave ovens generate unwanted heat inside an electrical enclosure which needs to be dissipated to the atmosphere. The method of dissipation may include drawing in cold air to absorb energy from hot components and exhaust warmer air. The particulate within the cold air inside the electrical enclosure, has a detrimental effect on the function and service life of the electrical components within the electrical enclosure.

Accordingly, it has been determined by the present disclosure, there is a need for a device to reduce or eliminate flow of air that is unfiltered into a cooking device. There is a further need for a device to monitor the presence or absence of a filter on a cooking device.

BRIEF SUMMARY OF THE INVENTION

A cooking device includes a housing having an opening, an airflow device that draws air into the housing through the opening, a filter that is removably connected to the housing to cover the opening, and a controller that controls an amount of the air drawn into the housing based upon a presence of the filter covering the opening or an absence of the filter covering the opening.

The above-described and other advantages and features of the present disclosure will be appreciated and understood by those skilled in the art from the following detailed description, drawings, and appended claims.

DETAILED DESCRIPTION OF THE INVENTION

Figure 1:
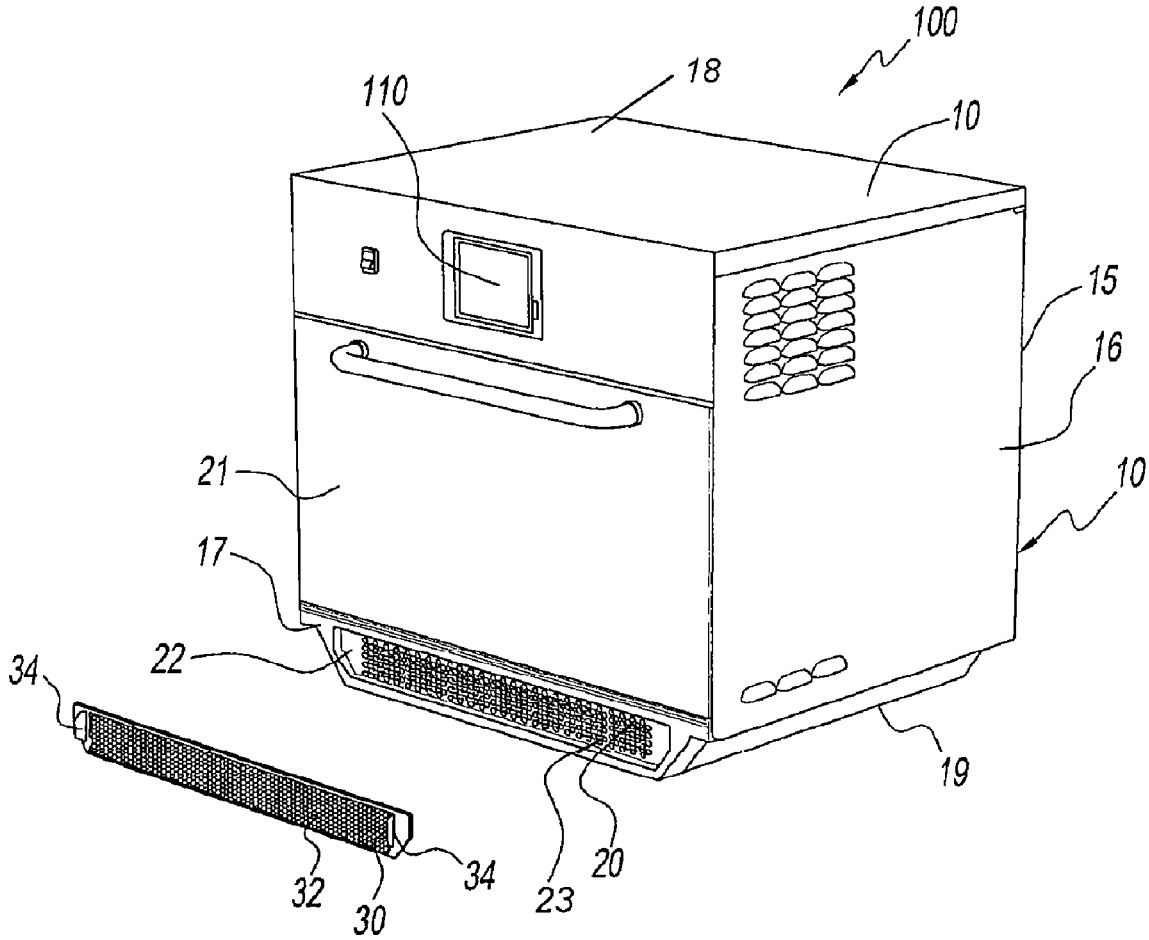
FIG. 1 is a front perspective view of a cooking device according to the present disclosure having a filter removed.

Referring to the drawings and in particular to FIG. 1, an exemplary embodiment of a cooking device according to the present disclosure is generally referred to by reference numeral 100. Cooking device 100 may be any device that heats food, such as, for example, an oven.

Cooking device 100 has a housing 10. Housing 10 includes a rear wall 15, a first side wall 16, a second side wall (not shown), a front wall 17, a top wall 18, and a bottom wall 19. A door 21 is connected to front wall 17. Door 21 covers an opening to a cooking chamber when door 21 is in a closed position and provides access to the cooking chamber when door 21 is moved away from front wall 17 in an open position. Front wall 17 has an opening 20. Opening 20 may be located at a bottom portion of front wall 17. Opening 20 has a plurality of apertures 23 through housing 10. However, opening 20 may be a single opening through housing 10.

Cooking device 100 has a filter 30. Filter 30 has a plurality of holes 32. Filter 30 may be a material that is any material that filters air entering cooking device 100. For example, filter 30 may be stainless steel mesh, however alternative materials, such as, for example, air filtering sponges, fibers, and the like can be used. Filter 30 may be a coarse woven wire layer filter. Filter 30 reduces amount of particulate transferred from outside of cooking device 100 into the cooking device. Filter 30 also reduces a size of the particulate transferred from outside of cooking device 100 into the cooking device. Filter 30 is shaped to cover opening 20. Filter 30 is removably connectable to housing 10 to cover opening 20. Opening 20 may be disposed in a recessed portion 22 of housing 10 so that filter 30 fits within recessed portion 22 to connect to housing 10. Filter 30 is attached using magnets, however, alternative friction fit, clasped or latching mechanisms or fixings could be used. The position of opening 20 on front wall 17 positions filter 30 so that it is easily accessible to users for maintenance. Such a location allows filter 30 to be visible to users in order for the user to ensure the filter is connected to cooking device 100 as well as determine when the filter should be cleaned.

Figure 2:
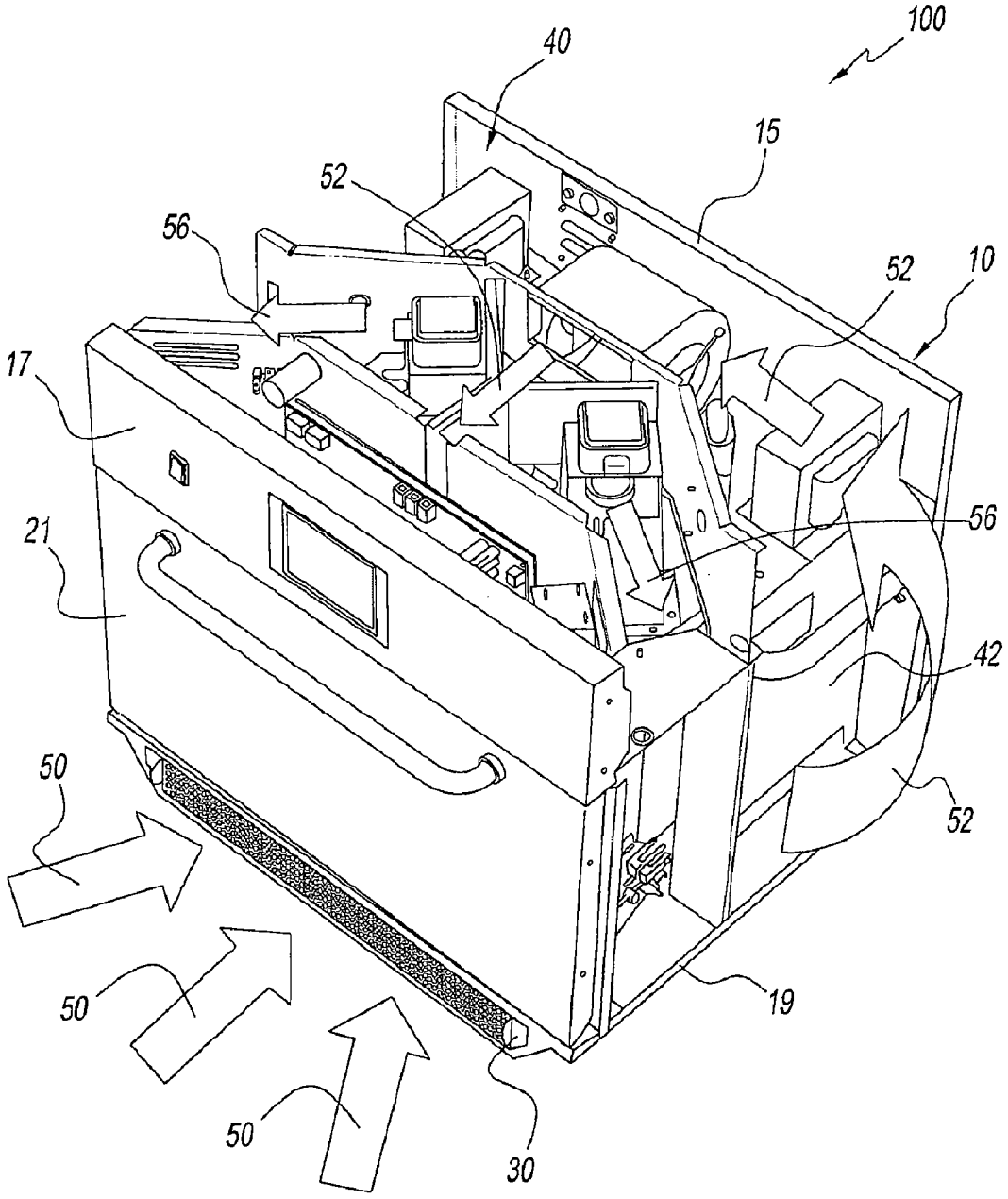
FIG. 2 is a partial top perspective view of the cooking device of FIG. 1 having the filter connected.

Referring now to FIG. 2, a partial top perspective view of cooking device 100 is shown having filter 30 connected to housing 10 and top wall 18, first sidewall 16 and the second sidewall removed from cooking device 100. Cooking device 100 has a duct 40. Duct 40 may be a volume between housing 10 and an enclosure 42. Enclosure 42 is the cooking chamber that holds food while being heated during operation of cooking device 100.

An airflow device draws air through opening 20, as shown by arrows 50, into a duct 40. The air has a temperature that is lower than a temperature within duct 40. The airflow device draws the air into duct 40 into contact with components of cooking device 100, as shown by arrows 52. The air in contact with the components of cooking device 100 cools the components. Components of cooking device 100 are, such as, for example, a magnetron, fan motor, and other components of an oven where cooling during operation of cooking device 100 is desirable, within duct 40. The air is then exhausted from duct 40 out of cooking device 100, as shown by arrows 56.

Figure 3:
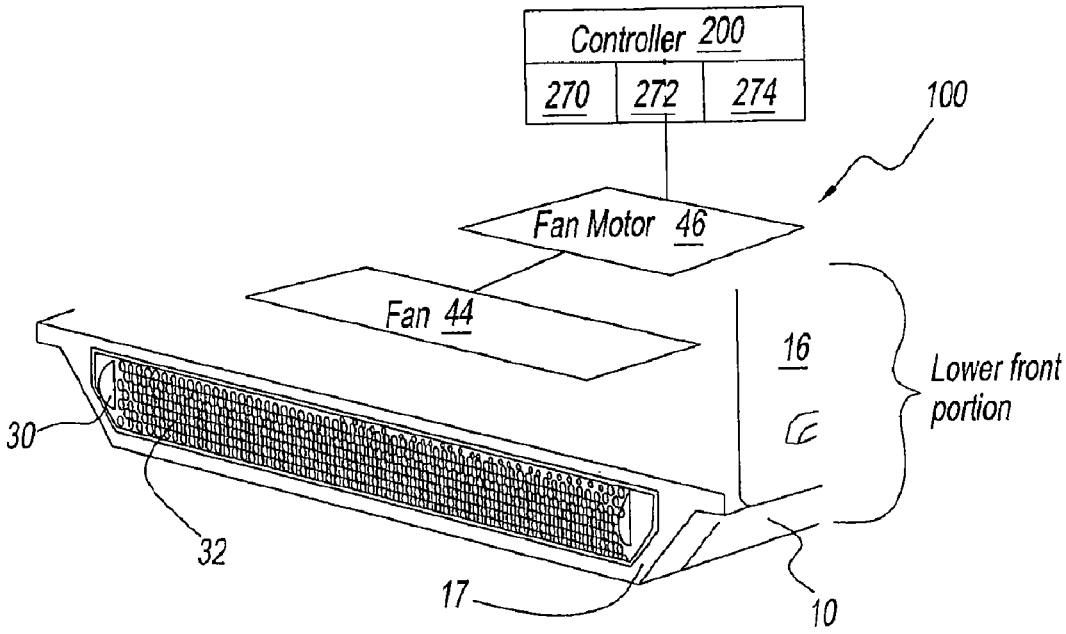
FIG. 3 is an enlarged partial front perspective view of the cooking device of FIG. 1 having the filter connected.
Figure 4:
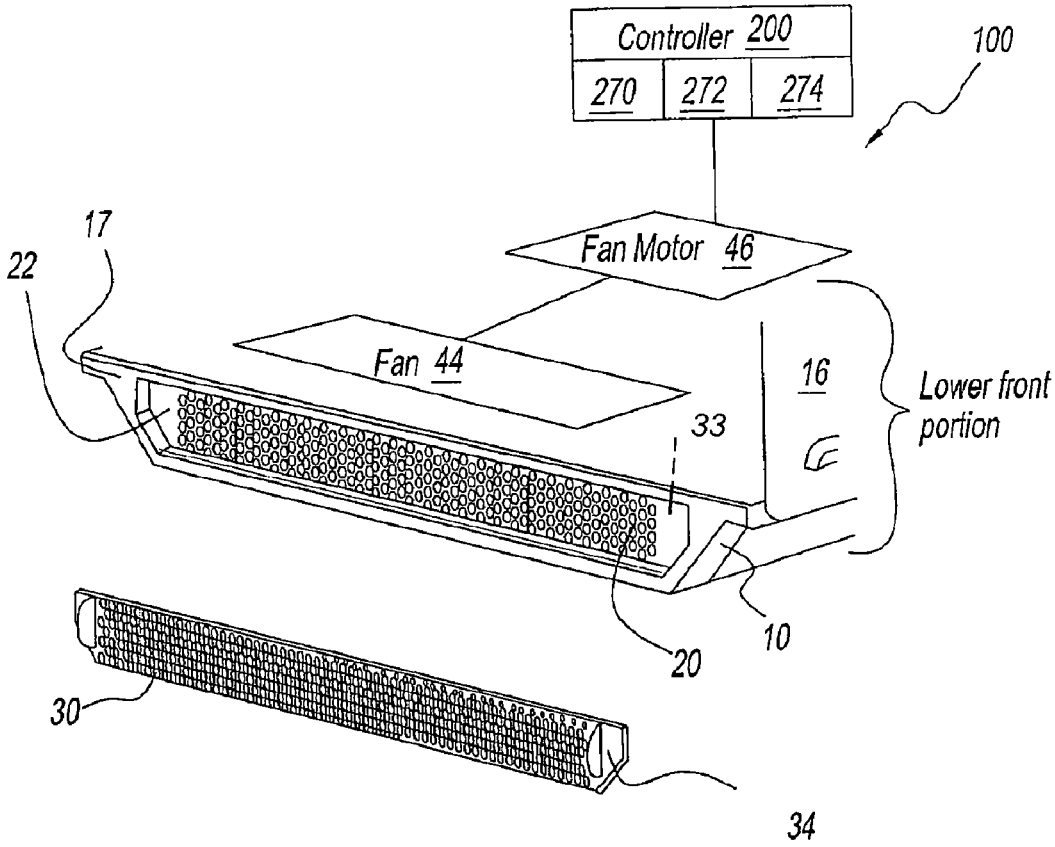
FIG. 4 is an enlarged partial front perspective view of the cooking device of FIG. 1 having the filter removed.

Referring now to FIGS. 3 and 4, cooking device 100 includes a controller 200 that controls the airflow device. Controller 200 may be connected to housing 10 or remote from cooking device 100, for example, a remote computer. Controller 200 includes a processor 270, a memory 272 and a control program 274 stored in memory 272. Program 274 when run by processor 270 causes controller 200 to operate the airflow device to vary an amount of air drawn through opening 20 into housing 10 based upon a presence of filter 30, when filter covers opening 20, and an absence of filter 30, when filter 30 is not covering opening 20.

The airflow device may be a fan 44 having a fan motor 46. When fan motor 46 rotates fan 44, an internal pressure is generated within duct 40 to draw air through opening 20 into duct 40.

Housing 10 has a sensor device that detects a presence of filter 30, when filter covers opening 20, and an absence of filter 30, when filter 30 is not covering opening 20, and communicates an output indicative of the presence or absence of filter 30 to controller 200. A reed switch may be used, however, any type of proximity switch, for example, microswitches, monitoring mechanisms or activation buttons could be used. The output may be received by controller 200 from the sensor device via a communication means which may include an internet communication (e.g., email), a direct dial-up (modem) connection, wireless communication or any other communication method now known or developed in the future which is capable of transmitting such outputs from the sensor device to controller 200. The sensor device has a sensor 33, as shown in FIG. 4, that is disposed in proximity to opening 20 within duct 40. For example, sensor 33 is connected to housing 10 directly adjacent opening 20.

Filter 30 has actuator 34 that communicates with sensor 33 when filter 30 covers opening 20. Actuator 34 breaks contact with sensor 33 when filter 30 is moved away or removed from housing 10 uncovering opening 20 so that actuator 34 no longer communicates with sensor 33. For example, actuator 34 may be a magnet and sensor 33 may be a switch. The magnet of actuator 34 attracts a portion of the switch when filter 30 is covering opening 20 establishing contact between the magnet and the switch. The magnet of actuator 34 is moved away from the switch of sensor 33 when filter 30 is moved away from opening 20 beyond a distance that the magnet attracts the portion of the switch, breaking the contact between the magnet and the switch.

Controller 200 operates the airflow device so that the airflow device draws an increased amount of air through opening 20 when the sensor device detects the presence of filter 30 and the airflow device draws a decreased amount of air through opening 20 when the sensor device detects the absence of filter 30. The decreased amount of air is less than the increased amount of air.

Figure 5:
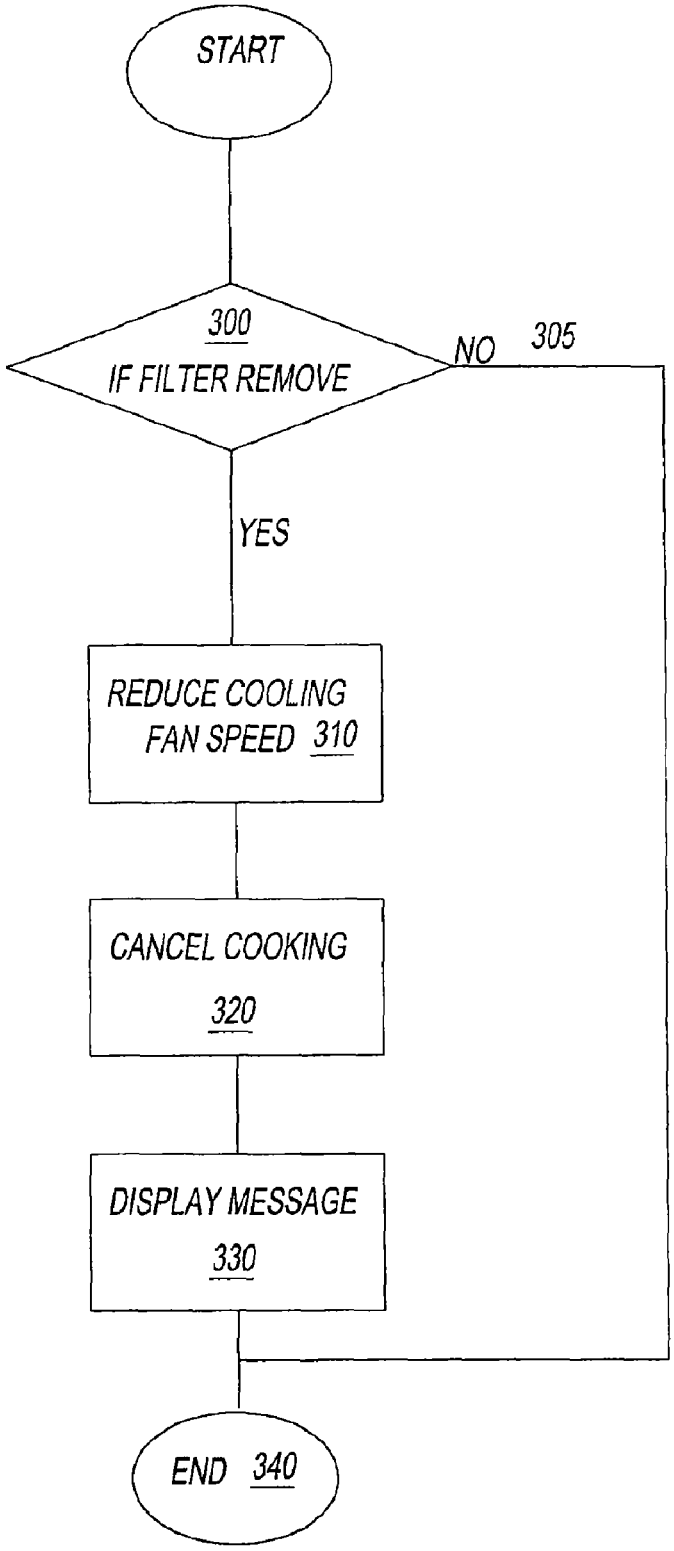
FIG. 5 is a logic and flow diagram of a controller of the present disclosure.

Referring to FIG. 5, a logic and flow diagram shows a process to control an amount of air drawn into housing 10 of cooking device 100. Program 274 when run by processor 270 operates as shown in FIG. 5 and as described below. During operation of cooking device 100, sensor 33 detects the presence or absence of actuator 34 on filter 30 and generates a corresponding output to controller 200. Controller 200 receives the output and determines if the output indicates a presence or an absence of filter 30, as shown in step 300. If the output indicates a presence of filter 30 and fan motor 46 is rotating fan 44 at a predetermined increased speed, controller 200 maintains fan 44 at the predetermined increased speed, as shown by step 305, and the protocol procedure is done in step 340 and no further action would be taken at time of output receipt by controller 270. When filter 30 is in place, fan speed is running at 100%.

If controller 200 receives an output indicating an absence of filter 30 and fan motor 46 is rotating fan 44 at the predetermined increased speed, controller 200 varies fan motor 46 to reduce rotation of fan 44 to a predetermined decreased speed that is less than the increased speed, as shown in step 310. When filter 30 is removed, the fan speed may be reduced to ⅓ of full speed. Controller 200 may also control cooking of cooking device 100, and cancel any cooking operation of cooking device 100 when controller receives an output indicating an absence of filter 30, as shown in step 320. Controller 200 may also control a display 110, as shown in FIG. 1, and display a message on display 110 when controller receives the output indicating an absence of filter 30, as shown in step 330. The message may indicate to the user that filter 30 needs to be connected to cooking device 100 or replaced. The protocol procedure is done in step 340 and no further action would be taken at time of output receipt. Controller 200 may continue to monitor the sensor device after step 340 and repeat the process of the logic and flow diagram in FIG. 5.

Additional steps of the process of the logic and flow diagram in FIG. 5 may include, if controller 200 receives an output indicating the presence of filter 30 and fan motor 46 is rotating fan 44 at the predetermined decreased speed, controller 200 varies fan motor 46 to increase fan 44 to the predetermined increased speed that is greater than the decreased speed. Controller 200 may also control cooking of cooking device 100, and permit cooking operations of cooking device when controller receives the output indicating the presence of filter 30. Controller 200 may also control display 110, as shown in FIG. 1, and display a message on display 110 when controller receives the output indicating the presence of filter 30.

Controller 200 may monitor the presence and absence of filter 30 covering opening 20 to regulate cleaning of filter 30 for optimal operation. Program 274 when run by processor 270 may cause controller 200 to store the output of the sensing device in memory 272. Used in conjunction with the operation timings/counters of cooking device 100, filter 30 is requested for cleaning via display 110 requiring a removal and replacement after cleaning of filter 30.

It has been determined by the present disclosure that operating the airflow device so that the airflow device draws the increased amount of air through opening 20 when the sensor device detects the presence of filter 30 and the airflow device draws the decreased amount of air through opening 20 that is less than the increased amount of air when the sensor device detects the absence of filter 30 reduces or prevents an amount of air that does not pass through filter 30 into cooking device 100. Advantageously, reducing or preventing an amount of air that does not pass through filter 30 into cooking device 100 reduces or prevents particulate within air inside housing 10 that has a detrimental effect on the function and service life of electrical components within housing 10. The predetermined decreased speed may be small enough so that the components cooled by the air drawn into cooking device 100 by the airflow device are maintained at a predetermined maximum temperature of no more than about 10 degrees Celsius to about 70 degrees Celsius while the unfiltered air is reduced. The predetermined decreased speed may deactivate the airflow device.

It has also been determined by the present disclosure that monitoring the presence and absence of filter 30 may be used to regulate cleaning of filter 30 for optimal operation. Advantageously, monitoring filter 30 for cleaning promotes a longer service life of cooking device 100.

It should also be noted that the terms "first", "second", "third", "upper", "lower", "above", "below", and the like may be used herein to modify various elements. These modifiers do not imply a spatial, sequential, or hierarchical order to the modified elements unless specifically stated.

While the present disclosure has been described with reference to one or more exemplary embodiments, it will be understood by those skilled in the art that various changes may be made and equivalents may be substituted for elements thereof without departing from the scope of the present disclosure. In addition, many modifications may be made to adapt a particular situation or material to the teachings of the disclosure without departing from the scope thereof. Therefore, it is intended that the present disclosure not be limited to the particular embodiment(s) disclosed as the best mode contemplated, but that the disclosure will include all embodiments falling within the scope of the appended claims.

What is claimed is:

1. A cooking device comprising:

a cooking chamber;

a housing surrounding said cooking chamber and having an opening, said cooking chamber and said housing forming a duct therebetween;

an airflow device that draws air into said duct through said opening from outside of the cooking device;

a filter that is removably connected to said housing to cover said opening; and a controller that controls an amount of said air drawn into said duct from outside of the cooking device based upon a presence of said filter covering said opening or an absence of said filter covering said opening.

2. The cooking device of claim 1, further comprising a sensor device that detects said presence or said absence of said filter to provide an output to said controller, and wherein said output comprises a first sensor output indicative of said presence of said filter and/or a second sensor output indicative of said absence of said filter.

3. The cooking device of claim 2, wherein said controller controls said airflow device so that said airflow device draws an increased amount of air through said opening when said sensor device detects said presence of said filter and said airflow device operates to draw a decreased amount of air through said opening when said sensor device detects said absence of said filter.

4. The cooking device of claim 3, wherein said increased amount of air is greater than said decreased amount of air.

5. The cooking device of claim 2, wherein said sensor device comprises a magnetic switch.

6. The cooking device of claim 2, wherein said airflow device comprises a fan and a fan motor, wherein if said output indicates said absence of said filter and said motor is rotating said fan at a predetermined increased speed, said controller reduces rotation of said fan to a predetermined decreased speed, and wherein said predetermined increased speed is greater than said predetermined decreased speed.

7. The cooking device of claim 1, wherein said controller generates a signal selected from the group consisting of a signal to a user when said filter is present, a signal to a user when said filter is absent, and any combination thereof.

8. The cooking device of claim 1, wherein said air within said duct cools components of the cooking device.

9. The cooking device of claim 1, wherein said controller monitors said presence and said absence of said filter to regulate cleaning of said filter.

10. The cooking device of claim 1, wherein said sensor device comprises a sensor actuator on said filter and a sensor on said housing proximal to said opening, and wherein when said sensor actuator breaks contact with said sensor, said sensor detects said absence of said filter and when said sensor actuator contacts said sensor, said sensor detects said presence of said filter.

11. The cooking device of claim 2, wherein said controller controls the cooking device so that cooking operations are canceled when said sensor detects said absence of said filter.

12. A method comprising:

detecting a presence or an absence of a filter covering an opening through a housing of a cooking device, said housing surrounding a cooking chamber to form a duct therebetween; and increasing an amount of air drawn into said duct from outside of said cooking device to an increased amount and/or decreasing said amount of air drawn into said duct from outside of said cooking device to a decreased amount based upon said presence or said absence.

13. The method of claim 12, wherein said increasing said amount of air drawn into said duct to said increased amount and/or decreasing said amount of air drawn into said duct to said decreased amount comprises increasing said amount of air drawn into said duct to said increased amount when said presence is detected.

14. The method of claim 12, wherein said increasing said amount of air drawn into said duct to said increased amount and/or decreasing said amount of air drawn into said duct to said decreased amount comprises decreasing said amount of air drawn into said duct to said decreased amount when said absence is detected.

15. The method of claim 12, wherein said airflow device comprises a fan that draws said air within said duct, and wherein said increasing said amount of air drawn into said duct to said increased amount and/or decreasing said amount of air drawn into said duct to said decreased amount comprises increasing a fan speed to increase said amount of air drawn into said duct to said increased amount and/or decreasing said fan speed to decrease said amount of air drawn into said duct to said decreased amount.

16. The method of claim 12, further comprising generating a signal selected from the group consisting of a signal to a user when said filter is present, a signal to a user when said air filter is absent, and any combination thereof.

17. The method of claim 12, further comprising cooling components of the cooking device within said duct with said air drawn into said duct.

18. The method of claim 12, further comprising monitoring said presence and said absence of said filter to regulate cleaning of said filter.

19. The method of claim 12, further comprising cooking food within said cooking device and canceling cooking when said absence is detected.

* * * * *